US005778816A

United States Patent [19]

DiGiulio

[11] Patent Number: 5,778,816

[45] Date of Patent: Jul. 14, 1998

[54] PORTABLE WIND SCOOP FOR BOAT PORT HOLES

[76] Inventor: Matthew Vincent DiGiulio, 79 Barrow St., New York, N.Y. 10014

[21] Appl. No.: 867,148

[22] Filed: Jun. 2, 1997

[51] Int. Cl.[6] ..... B63J 2/00

[52] U.S. Cl. ..... 114/211; 454/78

[58] Field of Search ..... 114/211, 177, 114/178; 454/78

[56] References Cited

U.S. PATENT DOCUMENTS

| | | | |
|---|---|---|---|
| 293,975 | 6/1884 | Herman | 454/78 |
| 4,434,740 | 3/1984 | Childs | 114/211 |
| 5,588,386 | 12/1996 | Schilt | 114/211 |

*Primary Examiner*—Stephen Avila
*Attorney, Agent, or Firm*—Robert I. Pearlman

[57] ABSTRACT

A portable windscoop for boat portholes fabricated of a flexible plastic or similar material with flange portions at its side periphery. The windscoop is adapted to be pressured into a curved body, scoop or funnel having an open end. The flange portions are adapted to be snapped into the side portions of an open porthole with the natural tension of the plastic or similar material serving to hold the scoop in place with its open end facing the bow of the vessel. Wind is thus directed into the interior of the vessel through the open porthole having the windscoop in place in both rain or shine. The scoop is readily removed by pressing its sides and thus releasing its flange portions from the side of the porthole.

8 Claims, 3 Drawing Sheets

PORTABLE WIND SCOOP FOR BOAT PORT HOLES

BACKGROUND OF THE INVENTION

This invention relates to a novel portable wind scoop unit adapted to be readily inserted into boat portholes as well as readily removed therefrom. It is particularly useful for use in pleasure boats, yachts and the like having elongated portholes.

Various ventilator systems including windscoops have been disclosed for ventilating the below deck areas of marine vessels. Normally permanently installed systems have been used. During World War II combinations of permanently fixed windscoops and light blocking designs were used to avoid disclosing the ship's position to the enemy. Examples thereof are disclosed in U.S. Pat. Nos. 2,317,712; 2,354,795 and 2,348,886 among other disclosures.

Many of the prior art systems required complex mechanisms for insuring water and air tight sealing of the permanently fixed ventilation systems. Such systems, however, are normally not practical for use in pleasure boats.

Attempts have been made to utilize simpler air scoop designs. U.S. Pat. No. 2,981,218 discloses a combination porthole screen and wind scoop design wherein the windscoop is fixed into place with screws. U.S. Pat. No. 4,434,740 teaches a windscoop formed from a fabric member being fitted onto resilient bent wire members. The unit is used on boat deck hatch openings rather than portholes.

None of the prior art systems offer complete ease of addition and removal of the windscoop. Those systems requiring cutting of channels and/or openings into the boat structure create possible openings for water to be taken on (and possible capsizing of the vessel in the event of storms or the like). Prior art ventilation systems such as mounted vertical sails on the deck are bulky and close off the hatchway entry and exit. Further, they can not be used in rain when the hatches must be closed.

In accordance with the present invention, an inexpensive windscoop unit for use in boat portholes is taught which can be readily inserted or removed in a matter of seconds and is a relatively low cost unit.

A unit of flexible plastic, such as polypropylene, polyethylene or materials of equivalent physical characteristics, is provided having flange portions or elements along its sides. The unit is stored as an essentially flat body having side peripheral edges descending therefrom. However, it is capable of being pressured into a curved body, scoop or funnel having an open end to receive airflow. When flexed into its curved configuration, the flange portions of the scoop unit are adapted to be snapped into the side portions of an open porthole with the natural tension of the material used for the scoop holding the unit securely to the porthole unit. The scoop unit is placed so that its open end faces the bow of the vessel so as to direct wind into the interior of the vessel through the scoop opening and the open porthole since an anchor a boat faces into the wind.

In addition to the advantages afforded to the boat owner, the windscoop units of the present invention are stored by the customer or retailer in the form of flat stacks. The length of the unit can be varied to fit the length of the porthole by simply cutting the unit to size as sold. No other elements, such as screws, wires, flanges or the like are required.

Accordingly the windscoop of the present invention is inexpensive, simple in construction, readily installed or removed and requires no complementary structure or fixing the unit in place other than the conventional porthole system itself. The unique single element design permits its movement from the store shelf or storage area to insertion into the port hole for use in a matter of seconds.

Other features and advantages of the present invention will be apparent from the following description when read with reference to the accompanying drawings.

DESCRIPTION OF THE PREFERRED EMBODIMENT

Figure 2:
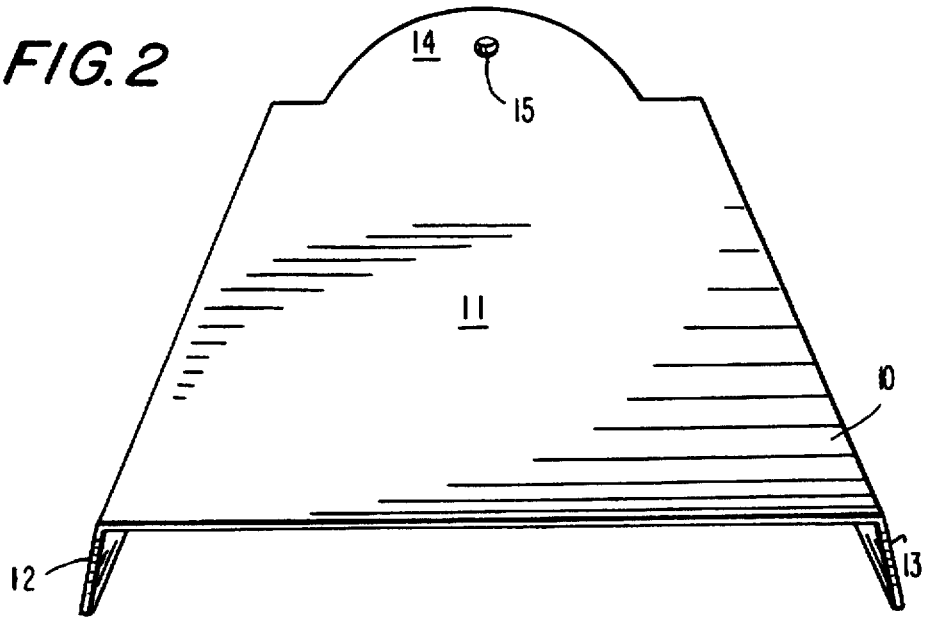
FIG. 2 is a top view of the windscoop of FIG. 1.
Figure 3:
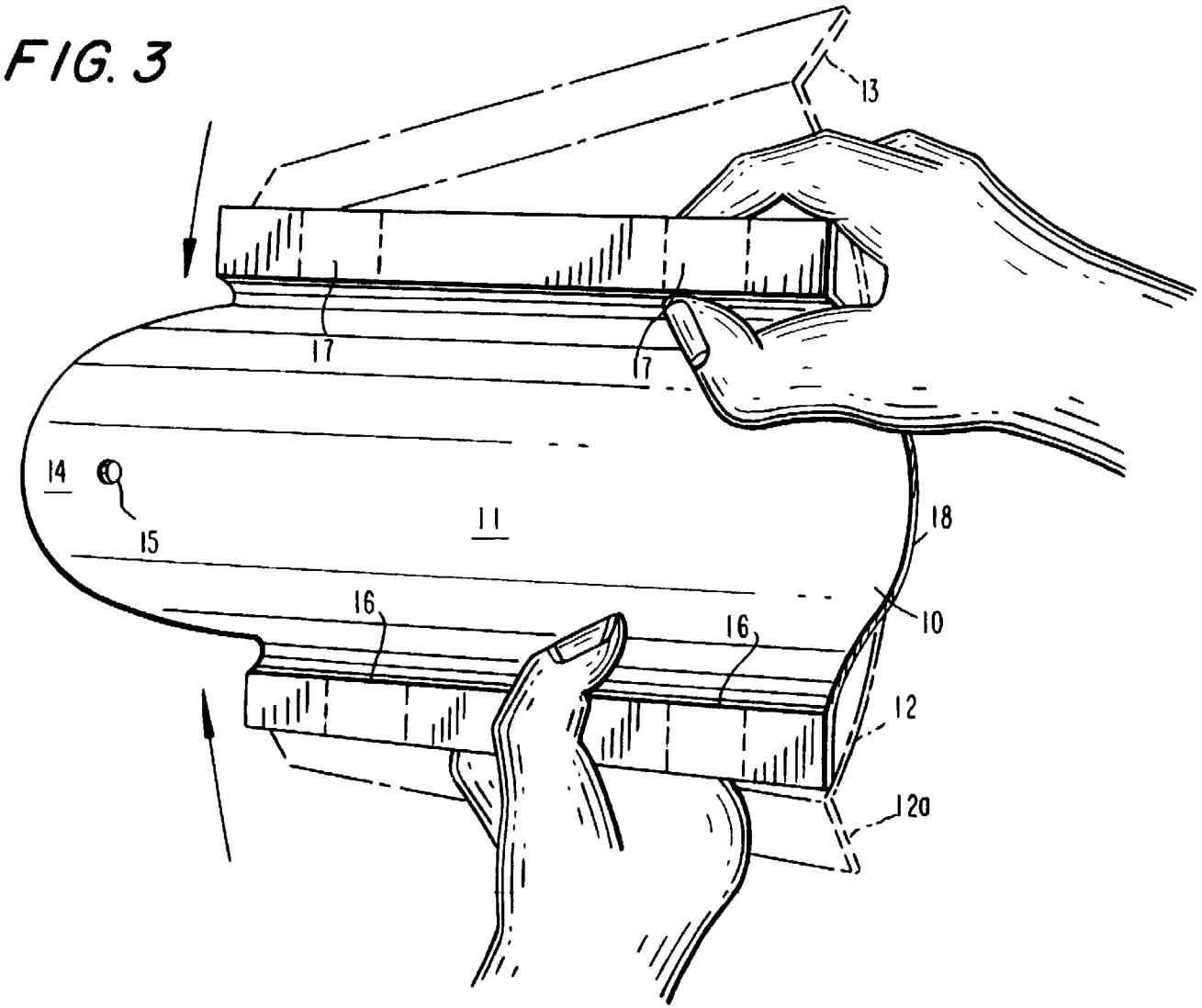
FIG. 3 illustrates the curvature of the windscoop when pressure is applied to its sides just prior to its insertion into the vessel porthole.

Referring in detail to the drawings wherein like numerals designate like parts throughout the several views, when not in use windscoop unit 10 comprises a substantially flat body portion 11 having a diverging end portion 18 and a narrower tongue portion 14. When in place after compression portion 18 forms the scoop/funnel area for letting air into the porthole of the vessel. The lateral portions 12 and 13 of the unit descend from body 11 as best shown in FIG. 2. The unit 10 is made up of a plastic sheet such as polypropylene, polyethylene, or a flexible clear acrylic polymer which is capable of being bent into an arched configuration as shown in FIG. 3 when about to be inserted into the open porthole of a vessel. When tension is released the plastic unit returns to its prior relatively flat geometry.

Figure 1:
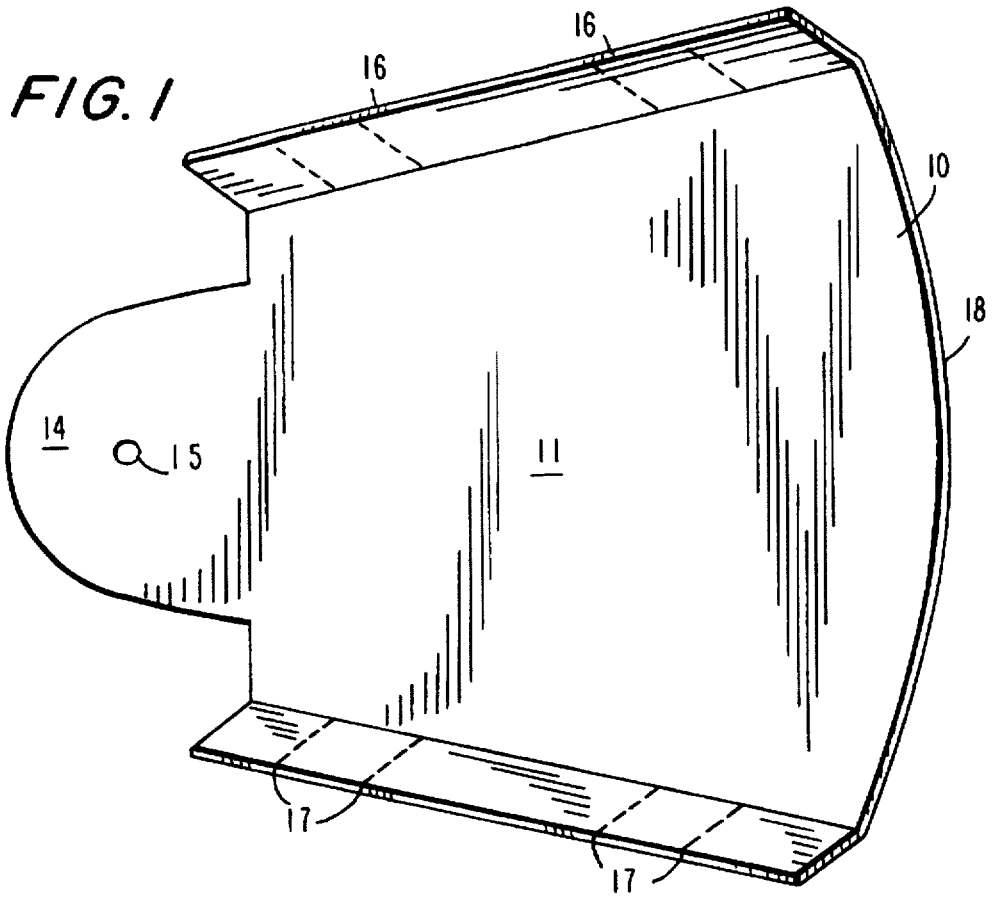
FIG. 1 is an interior view of the windscoop of the present invention prior to compression for installation into a porthole.

FIGS. 1 and 2 show the optional use of eyehole 15 which serves as an easy storage means for the retailer selling the unit or for the vessel owner storing the units when not in use. In either case, they may be placed in a stacked configuration on a nail, hook or the like. The length of the unit may be readily cut to custom fit the porthole to be fitted.

Figure 4:
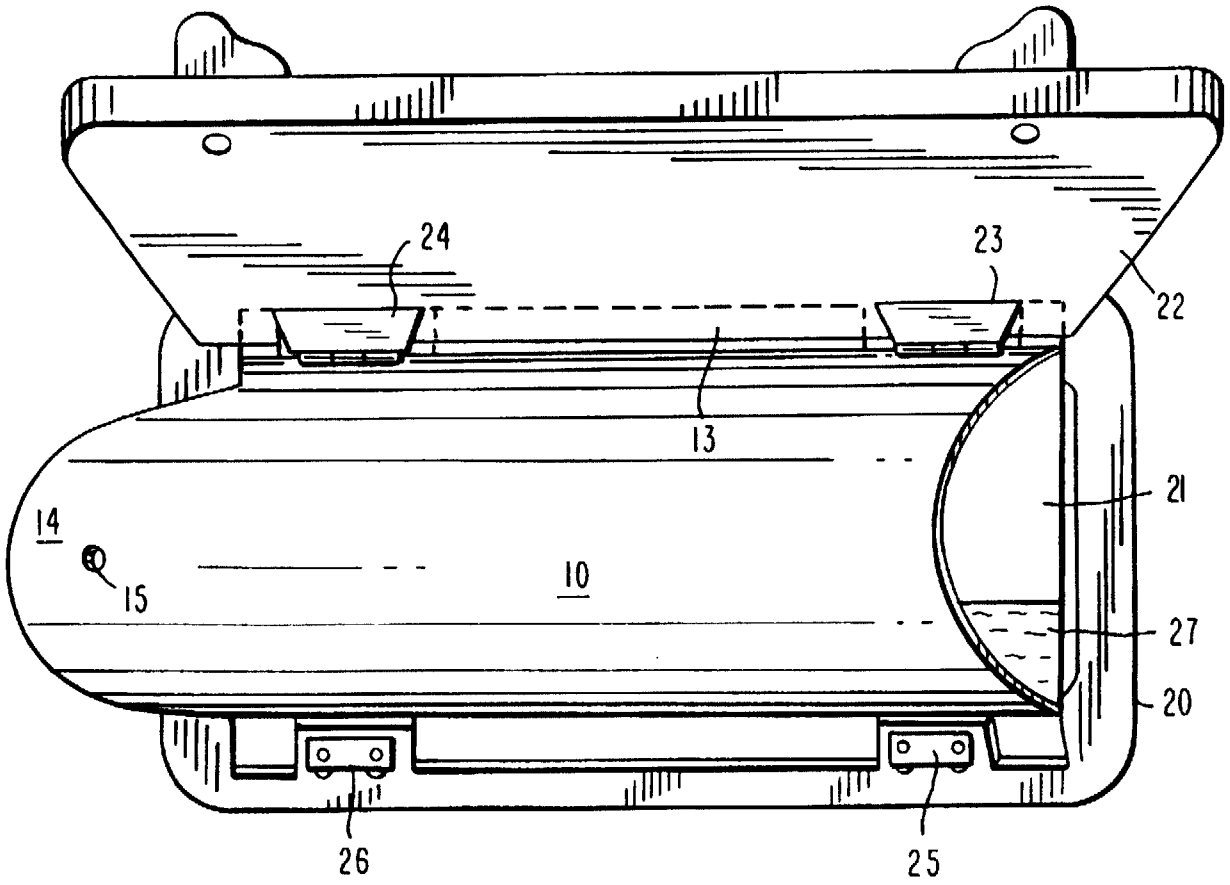
FIG. 4 shows an interior view looking out an open porthole with the windscoop inserted with its lateral flange portions holding it in place.

Tab lines 16 on flange section 12 as well as similar tab lines 17 on flange section 13 denote those areas of the windscoop unit 10 to be cut out to allow for the placement of the scoop over the porthole hinges 25 and 26 and snug fit as shown in FIG. 4. FIG. 4 which shows placement of the windscoop unit 10 in the open window 21 of an elongated porthole 20. The present invention is intended to be used in conventional oblong, rectangular or other elongated porthole units.

As best illustrated in FIG. 3, when the scoop unit 10 is to be inserted into an open porthole (whose cover 22 has been opened as shown in FIG. 4), the user applies lateral pressure to the side flanges 12 and 13 of the unit causing the center body portion 11 to compress and form a curved scoop/funnel portion 18 as well as compressed flange portions 12 and 13. The position of the flange portions prior to compression are denoted as 12*a* and 13*a* respectively.

In order to ensure a good fit of the present windscoop, lateral portions 12 and 13 typically extend 0.5 to 1.0 inches downward from body portion 11.

The degree of curvature of the scoop will vary with the size of the porthole to be fitted with it being greater the smaller the porthole. In all events it is sufficient to create a significant scooped cross section.

The compressed curved scoop unit is then inserted into an elongated porthole as shown in FIG. 4. FIG. 4 is a view looking out from the boat interior towards the water 27. Lateral portions 12 and 13 of the windscoop are fitted against the sides of the porthole, normally into the area between the rubber gasket and upper metal portion above the porthole opening. The natural tension of the scoop unit 10 when put into its sharply arched configuration will hold the scoop in place via its peripheral flanges pressing against the sides of the porthole unit. While preferably inserted between the rubber gasket 23 and metal frame, the lateral flange portions of the present unit can also be held in place by positioning into other openings in the porthole structure.

FIG. 4 shows a typical oblong porthole unit 20. As illustrated it is 10 inches wide and 6 inches high having a window opening 21 normally covered by cover 22. The tabs 16 and 17 of FIGS. 1–3 have been cut to snugly fit about hinges 25 and 26. The curved end 18 of the scoop unit formed when it is compressed and inserted into the porthole opening comprises the inlet area of the windscoop with air flowing into it as shown by the arrow. Open end 18 faces the bow of the vessel so as to direct wind into the interior of the vessel through the windscoop. If the boat is tied to the dock facing away from the wind, the direction of the windscoop is reversed.

When it is desired to close the portholes and to remove the windscoops, e.g. storage of the vessel, windy conditions, or the vessel getting underway, they can be removed in a matter of seconds. Pressure is applied to the sides of unit 10 in the areas proximate to lateral portions 12 and 13 (in like manner as shown in FIG. 3).

This relieves the natural tension outward of the flange portions 12 and 13, thus freeing them from their position against the side of the porthole. They are then simply removed in seconds and stored for the future.

Thus the present invention provides a readily insertible as well as removal windscoop system which is easily stored and relatively inexpensive.

Various modifications may be made to the present invention for example the outside surface of the windscoop may have a decorative design or a textured surface to enhance its appearance. The inside surface may also be textured for decorative effect.

While a preferred form of the invention has been described as above by way of example, it is to be understood that the invention is not necessarily confined thereto. My invention comprises all the embodiments and modifications within the scope and spirit of the following claims.

What is claimed is:

1. A readily insertable and removable windscoop adapted to be inserted into an elongated open porthole, comprising in combination, a compressible windscoop unit having a body portion, a narrowed tongue section at one end of said body portion and an expanded section at its other end, said windscoop have lateral flange portions at its sides extending downward from the plane of said body portion when not in use; said windscoop being adapted to be compressed prior to insertion into said elongated open porthole so that said expanded section provides an entry for airflow and said lateral flange portions are adapted to fit into the side openings of an open porthole with the natural tension of the compressible windscoop holding the unit in place in said porthole.

2. The windscoop of claim 1 wherein said lateral flange portions have tab lines adapted to be cut to appropriate size to fit the windscoop about the hinges found on the porthole.

3. The windscoop of claim 1 wherein said narrowed tongue section has a small hole so that when not in use the windscoop can be stored on a nailm hook or similar device.

4. The windscoop of claim 1 which is made of a compressible plastic capable of being easily compressed by the user into the form of a windscoop, and whose lateral flange portions can be easily inserted into the existing openings of an elongated porthole, and which can be readily removed therefrom by further compression so as to free said lateral portions.

5. The windscoop of claim 1 which is made of a compressible material selected from the group consisting of polypropylene, polyethylene or a flexible clear acrylic polymer.

6. The windscoop of claim 1 wherein said lateral flange portions extend from the expanded section of the windscoop up to the beginning of the narrowed tongue section.

7. The windscoop of claim 1 wherein the lateral flange portions extend 0.5 to 1.0 inches down from the body of the windscoop.

8. The windscoop of claim 1 which has been given a decorative appearance.

* * * * *